US005425184A

United States Patent [19]

Lyden et al.

[11] Patent Number: 5,425,184

[45] Date of Patent: Jun. 20, 1995

[54] ATHLETIC SHOE WITH REARFOOT STRIKE ZONE

[75] Inventors: Robert M. Lyden; Gordon A. Valiant, both of Beaverton; Robert J. Lucas; Michael T. Donaghu, both of Portland, all of Oreg.; David M. Forland, Battle Ground, Wash.; Joel I. Passke, Portland, Oreg.; Thomas McGuirk, Portland, Oreg.; Lester Q. Lee, Gaston, Oreg.

[73] Assignee: Nike, Inc., Beaverton, Oreg.

[21] Appl. No.: 38,950

[22] Filed: Mar. 29, 1993

[51] Int. Cl.[6] ..... A43B 13/20

[52] U.S. Cl. ..... 36/29; 36/114; 36/59 C

[58] Field of Search ..... 36/102, 88, 103, 114, 36/25 R, 28, 29, 34 R, 35 R, 35 B, 59 C

[56] References Cited

U.S. PATENT DOCUMENTS

| | | | |
|---|---|---|---|
| D. 27,361 | 7/1897 | Waters . | |
| 30,037 | 7/1868 | Ausdall . | |
| D. 86,527 | 3/1932 | Klein . | |
| D. 115,636 | 7/1939 | Sperry . | |
| D. 136,226 | 3/1943 | Wright . | |
| 248,616 | 10/1881 | Shepard | 36/68 |
| D. 278,851 | 5/1985 | Austin | D2/320 |
| 280,791 | 7/1883 | Brooks . | |
| D. 288,027 | 2/1987 | Tonkel | D2/320 |
| D. 288,028 | 2/1987 | Chassaing | D2/320 |
| D. 296,152 | 6/1988 | Selbiger | D2/320 |
| D. 298,483 | 11/1988 | Liggettt et al. | D2/320 |
| D. 301,658 | 6/1989 | Hase | D2/320 |
| D. 305,955 | 2/1990 | Hase | D2/320 |
| D. 307,351 | 4/1990 | Kayano | D2/320 |
| D. 311,810 | 11/1990 | Hatfield | D2/320 |
| D. 315,442 | 3/1991 | Kilgore et al. | D2/320 |
| D. 318,170 | 7/1991 | Hatfield | D2/320 |
| D. 319,532 | 9/1991 | Mitsui | D2/320 |
| D. 320,690 | 10/1991 | Lucas | D2/320 |
| D. 321,584 | 11/1991 | Mitsui | D2/277 |
| D. 321,973 | 12/1991 | Hatfield | D2/320 |
| D. 321,977 | 12/1991 | Kilgore et al. | D2/320 |
| D. 322,511 | 12/1991 | Lucas | D2/320 |
| D. 324,762 | 3/1992 | Hatfield | D2/318 |
| D. 324,941 | 3/1992 | Hatfield | D2/320 |
| D. 325,289 | 4/1992 | Aveni | D2/314 |
| D. 326,557 | 6/1992 | Gardner | D2/319 |
| D. 326,762 | 6/1992 | Kiyosawa | D2/277 |
| D. 329,528 | 9/1992 | Hatfield | D2/314 |
| D. 329,534 | 9/1992 | Worthington | D2/320 |
| D. 329,536 | 9/1992 | Lucas | D2/320 |
| D. 329,739 | 9/1992 | Hatfield | D2/318 |
| D. 329,936 | 10/1992 | Lucas | D2/314 |
| D. 329,939 | 10/1992 | Bailey | D2/320 |
| D. 330,800 | 11/1992 | Lucas | D2/320 |
| D. 334,279 | 3/1993 | Teague | D2/314 |
| D. 334,650 | 4/1993 | Teague | D2/314 |
| D. 335,015 | 4/1993 | Lozano | D2/314 |

(List continued on next page.)

FOREIGN PATENT DOCUMENTS 0083449 7/1983 European Pat. Off. .

(List continued on next page.)

OTHER PUBLICATIONS

The Air Structure shoe, Spring 1991 Nike Footwear, pp. 8–9, 12–13.

(List continued on next page.)

*Primary Examiner*—Bryon P. Gehman
*Assistant Examiner*—Ted Kavanaugh
*Attorney, Agent, or Firm*—Banner, Birch, Mckie & Beckett

[57] ABSTRACT

An athletic shoe has a sole with a rearfoot strike zone segmented from the remaining heel area by a line of flexion which permits articulation of the strike zone during initial heel strike of a runner. The line of flexion is located to delimit a rearfoot strike zone reflecting the heel to toe running style of the majority of the running population. In addition to allowing articulation of the rearfoot strike zone about the line of flexion, the sole incorporates cushioning elements, including a resilient gas filled bladder, to provide differential cushioning characteristics in different parts of the heel, to attenuate force applications and shock associated with heel strike, without degrading footwear stability during subsequent phases of the running cycle. The line of flexion may be formed by various means including a deep groove, a line of relatively flexible midsole material, and a relatively flexible portion of a segmented fluid bladder.

47 Claims, 5 Drawing Sheets

U.S. PATENT DOCUMENTS

| | | | |
|---|---|---|---|
| 500,385 | 6/1893 | Hall . | |
| 863,873 | 8/1907 | Pratt . | |
| 900,867 | 10/1908 | Miller . | |
| 940,856 | 11/1909 | Critz, Jr. . | |
| 1,304,915 | 5/1919 | Spinney . | |
| 1,850,752 | 3/1932 | Ice et al. . | |
| 1,855,452 | 4/1932 | Jones . | |
| 2,090,881 | 8/1937 | Wilson | 36/29 |
| 2,124,986 | 7/1938 | Pipes | 36/59 |
| 2,155,166 | 4/1939 | Kraft | 36/59 |
| 2,162,912 | 6/1939 | Craver | 36/59 |
| 2,177,116 | 7/1937 | Persichino | 36/153 |
| 2,206,860 | 7/1940 | Sperry | 36/59 |
| 2,244,504 | 6/1941 | Riddell | 36/68 |
| 2,328,242 | 8/1943 | Witherill | 36/59 |
| 2,345,831 | 4/1944 | Pierson | 12/146 |
| 2,470,200 | 5/1949 | Wallach | 36/33 |
| 2,488,382 | 11/1949 | Davis | 36/153 |
| 2,597,393 | 5/1952 | Slampa | 36/35 B |
| 2,599,871 | 6/1952 | Slampa | 36/35 B |
| 2,629,189 | 2/1953 | Stein | 36/8.5 |
| 2,677,906 | 5/1954 | Reed | 36/71 |
| 2,717,462 | 9/1955 | Goin | 36/71 |
| 2,723,468 | 11/1955 | Marcy | 36/68 |
| 2,922,235 | 1/1960 | Meltzer . | |
| 3,005,272 | 10/1961 | Shelare et al. | 36/29 |
| 3,044,190 | 7/1962 | Urbany | 36/29 |
| 3,087,262 | 4/1963 | Russell | 36/28 |
| 3,295,230 | 1/1967 | Szerenyi et al. | 36/59 |
| 3,487,563 | 1/1970 | Austin | 36/67 |
| 3,757,434 | 9/1973 | Granger, Jr. | 36/2.5 |
| 3,765,422 | 10/1973 | Smith | 128/594 |
| 3,849,915 | 11/1974 | Inohara | 36/67 B |
| 3,967,390 | 7/1976 | Anfruns | 36/94 |
| 4,059,910 | 11/1977 | Bryden et al. | 36/103 |
| 4,115,934 | 9/1978 | Hall | 36/29 X |
| 4,129,951 | 12/1978 | Petrosky | 36/29 |
| 4,180,924 | 1/1980 | Subotnick | 36/129 |
| 4,183,156 | 1/1980 | Rudy | 36/44 |
| 4,217,705 | 8/1980 | Donzis | 36/29 |
| 4,219,945 | 9/1980 | Rudy | 36/29 |
| 4,241,524 | 12/1980 | Sink | 36/102 |
| 4,255,877 | 3/1981 | Bowerman | 36/129 |
| 4,259,792 | 4/1981 | Halberstadt | 36/28 |
| 4,262,435 | 4/1981 | Block et al. | 36/129 |
| 4,263,728 | 4/1981 | Frecentese | 36/129 |
| 4,266,349 | 5/1981 | Schmohl | 36/32 R |
| 4,272,899 | 6/1981 | Brooks | 36/129 |
| 4,287,250 | 9/1981 | Rudy | 428/166 |
| 4,288,929 | 9/1981 | Norton et al. | 36/69 |
| 4,297,797 | 11/1981 | Meyers | 36/44 |
| 4,302,892 | 12/1981 | Adamik | 36/31 |
| 4,305,212 | 12/1981 | Coomer | 36/80 |
| 4,309,832 | 1/1982 | Hunt | 36/32 |
| 4,314,413 | 2/1982 | Dassler | 36/129 |
| 4,340,626 | 7/1982 | Rudy | 428/35 |
| 4,354,318 | 10/1982 | Frederick et al. | 36/30 R |
| 4,364,188 | 12/1982 | Turner et al. | 36/31 |
| 4,364,189 | 12/1982 | Bates | 36/31 |
| 4,377,041 | 3/1983 | Alchermes | 36/30 R |
| 4,393,605 | 7/1983 | Spreng | 36/114 |
| 4,439,936 | 4/1984 | Clarke et al. | 36/102 |
| 4,445,283 | 5/1984 | Meyers | 36/29 |
| 4,449,306 | 5/1984 | Cavanagh | 36/30 R |
| 4,476,638 | 10/1984 | Quacquarini et al. | 36/86 |
| 4,506,462 | 3/1985 | Cavanagh | 36/92 |
| 4,527,345 | 7/1985 | Lopez | 36/127 |
| 4,546,556 | 10/1985 | Stubblefield | 36/32 R |
| 4,550,510 | 11/1985 | Stubblefield | 36/32 R |
| 4,554,749 | 11/1985 | Ostrander | 36/102 |
| 4,557,059 | 12/1985 | Misevich et al. | 36/32 |
| 4,562,651 | 1/1986 | Frederick et al. | 36/102 |
| 4,570,362 | 2/1986 | Vermonet | 36/59 |
| 4,615,126 | 10/1986 | Mathews | 36/102 |
| 4,628,936 | 12/1986 | Langer et al. | 128/614 |
| 4,638,577 | 1/1987 | Riggs | 36/114 |
| 4,676,010 | 6/1987 | Cheskin | 36/32 R |
| 4,694,591 | 9/1987 | Banich et al. | 36/102 |
| 4,722,131 | 2/1988 | Huang | 29/450 |
| 4,724,622 | 2/1988 | Mills | 36/30 R |
| 4,724,624 | 2/1988 | Duclos | 36/116 |
| 4,731,939 | 3/1988 | Parracho et al. | 36/31 |
| 4,744,157 | 5/1988 | Dubner | 36/88 |
| 4,745,927 | 5/1988 | Brock | 128/581 R |
| 4,768,295 | 9/1988 | Ito | 36/28 |
| 4,777,738 | 10/1988 | Giese et al. | 36/32 R |
| 4,779,361 | 10/1988 | Kinsaul | 36/102 |
| 4,782,603 | 11/1988 | Brown | 36/29 |
| 4,785,557 | 12/1988 | Kelley et al. | 36/32 |
| 4,815,221 | 3/1989 | Diaz | 36/27 |
| 4,817,304 | 4/1989 | Parker et al. | 36/114 |
| 4,837,949 | 6/1989 | Dufour | 36/127 |
| 4,858,340 | 8/1989 | Pasternak | 36/88 |
| 4,864,739 | 9/1989 | Maestri | 36/43 |
| 4,934,072 | 6/1990 | Fredericksen et al. | 36/29 |
| 4,989,349 | 2/1991 | Ellis, III | 36/25 R |
| 5,005,299 | 4/1991 | Whatley | 36/25 R |
| 5,012,597 | 5/1991 | Thomasson | 36/59 |
| 5,014,449 | 5/1991 | Richard et al. | 36/114 |
| 5,024,007 | 6/1991 | DuFour | 36/127 |
| 5,046,267 | 9/1991 | Kilgore et al. | 36/114 |
| 5,048,203 | 9/1991 | Kling | 36/32 R |
| 5,097,607 | 3/1992 | Fredericksen | 36/291 |
| 5,131,173 | 7/1992 | Anderie | 36/25 R |
| 5,191,727 | 3/1993 | Barry et al. | 36/107 |
| 5,195,256 | 3/1993 | Kim | 36/35 B X |
| 5,317,819 | 6/1994 | Ellis, III . | |

(List continued on next page.)

FOREIGN PATENT DOCUMENTS

| | | |
|---|---|---|
| 0096543 | 12/1983 | European Pat. Off. . |
| 0316289 | 5/1989 | European Pat. Off. . |
| 0467506 | 1/1992 | European Pat. Off. . |
| 0500247 | 8/1992 | European Pat. Off. . |
| 337366 | 4/1904 | France . |
| 22515 | 7/1921 | France . |
| 997424 | 1/1952 | France . |
| 1122168 | 9/1956 | France . |
| 2614510 | 11/1988 | France . |
| 660551 | 7/1938 | Germany . |
| 680698 | 8/1939 | Germany . |
| 1290844 | 3/1969 | Germany . |
| 2927635 | 1/1981 | Germany . |
| 3741444 | 7/1988 | Germany . |
| 4018518 | 1/1991 | Germany . |
| 3927617 | 2/1991 | Germany . |
| 59-23525 | 7/1984 | Japan . |
| 183641 | 8/1922 | United Kingdom . |
| 471179 | 8/1937 | United Kingdom . |
| 856622 | 12/1960 | United Kingdom . |
| 2050145 | 1/1981 | United Kingdom . |
| 2134770 | 8/1984 | United Kingdom . |
| 2226746 | 7/1990 | United Kingdom . |
| 2228178 | 8/1990 | United Kingdom . |
| WO83/03528 | 10/1983 | WIPO . |
| WO90/00358 | 1/1990 | WIPO . |
| WO91/03180 | 3/1991 | WIPO . |
| WO91/04683 | 4/1991 | WIPO . |
| WO91/05491 | 5/1991 | WIPO . |
| WO91/10377 | 7/1991 | WIPO . |
| WO91/11124 | 8/1991 | WIPO . |
| WO91/11924 | 8/1991 | WIPO . |
| WO91/19429 | 12/1991 | WIPO . |
| WO92/07483 | 5/1992 | WIPO . |
| 93000838 | 1/1993 | WIPO . |

OTHER PUBLICATIONS

Sport Research Review, Women in Sports, Nike, Inc., Mar./Apr. 1990.

Footstrike Patterns in Distance Running, B. A. Kerr et al., *Biomechanical Aspects of Sports Shoes and Playing Surfaces,* Calgary, Canada, Aug. 1983, pp. 135–142.

Pronation and Sport Shoe Design, A. Atacoff and X. Kaelin, *Biomechanicl Aspects of Sports Shoes and Playing Surfaces,* Calgary, Canada, Aug. 1983, pp. 143–151.

Fall 1991 Nike Footwer Catalog.

Spring 1992 Nike Footwear Catalog.

Fall 1992 Nike Footwear Catalog.

Spring 1993 Nike Footwear Catalog, Jun., 1992.

The Air Structure shoe, Fall 1991 Nike Footwear, pp. 8–9.

The Air Structure shoe, Spring 1992 Nike Footwear, pp. 8–9, 12–13.

The Air Max shoe, Fall 1991 Nike Footwear, pp. 14, 15.

The Air Max St shoe, Fall 1991 Nike Footwear, pp. 8,9.

The Air Verona, Fall 1992 Nike Footwear, pp. 82–83.

Runner's World "Totally Tubular" article, discussing Adidas Tubular 2 and Tubular 4 shoes, Aug. 1993.

Biomechanics of Distance Running, Peter R. Cavanagh, PhD., 1990, pp. 154–158, 217.

Racing and Sports Car Chassis Design, Michael Costin and David Phipps, 1971.

Shoe Modifications in Lower–Extremity Orthotics, Isidore Zamosky, pp. 54–95.

Biomechanics of Running Shoes, Benno M. Nigg, Dr. sc. nat., 1986, p. 151.

Biomechanics IX–B, David A. Winter, Ph.D., et al., 1985, pp. 101–105.

Addidas Ad.

Photograph from *Athletic Footwear,* by Melvyn P. Cheskin, 1987, p. 19.

Turntec Ad, Runner, May 1986.

Physical Therapy, vol. 64, No. 12, Dec. 1984, pp. 1886–1901.

The Running Shoe Book, by Peter R. Cavanagh, Ph.D., 1980, pp. 35–36, 170–171.

ATHLETIC SHOE WITH REARFOOT STRIKE ZONE

BACKGROUND OF THE INVENTION

The invention pertains to footwear, and in particular to athletic footwear used for running. More specifically, the present invention pertains to athletic shoe constructions designed to attenuate force applications and shock and to enhance stability upon rearfoot strike during running.

The modern athletic shoe is a highly refined combination of elements which cooperatively interact in an effort to minimize weight while maximizing comfort, cushioning, stability and durability. However, these goals are potentially in conflict with each other in that efforts to achieve one of the objectives can have a deleterious effect on one or more of the others. As a result, the shoe industry has continued in its efforts to optimize these competing concerns. These efforts have in large part been directed at optimizing the competing qualities of cushioning and stability.

In modern athletic shoes, the sole ordinarily has a multi-layer construction comprised of an outsole, a midsole and an insole. The outsole is normally formed of a durable material such as rubber to resist wearing of the sole during use. In many cases, the outsole includes lugs, cleats or other elements to enhance traction. The midsole ordinarily forms the middle layer of the sole and is typically composed of a soft foam material to cushion the impact forces experienced by the foot during athletic activities. An insole layer is usually a thin padded member provided over the top of the midsole to enhance shoe comfort.

Up until the 1970's, athletic shoes were by and large considered deficient in providing cushioning for the wearer's foot. Consequently, numerous foot related injuries were sustained by those engaging in athletic activities. To overcome these shortcomings, over the ensuing years manufacturers focused their attention upon enhancing the cushioning provided by athletic shoes. To this end, midsoles have over time increased in thickness. These endeavors have further led to the incorporation of special cushioning elements within the midsoles intended to provide enhanced cushioning effects. In particular, the use of resilient inflated bladder midsole inserts, e.g., in accordance with the teachings of U.S. Pat. Nos. 4,183,156, 4,219,945, 4,340,626 to Rudy, and 4,813,302 to Parker et al., represents a marked improvement in midsole design and has met with great commercial success. (These patents are hereby incorporated by reference herein.) The industry's focus on improving cushioning effect has greatly advanced the state of the art in athletic shoe design. In some cases, however, the benefits realized in cushioning have been offset by a degradation of shoe stability.

To appreciate the potentially harmful effects of shoe instability, it is important to have a basic understanding of the dynamics of running and the anatomy of the foot. While the general population includes a wide variety of running styles, about 80% of the population runs in a heel-to-toe manner. In this prevalent running style, the foot does not normally engage the ground in a simple back to front linear motion.

When most persons run, their feet generally engage the ground under the approximate midline of their body, rather than to the sides as in walking. As a result, the foot is tilted upon ground contact such that initial engagement with the ground (commonly referred to as rearfoot strike or heel strike) usually occurs on the lateral rear comer of the heel. (See FIG. 1.) At heel strike the foot is ordinarily dorsi flexed and slightly inverted. Typically, the ankle angle $\alpha$ is within approximately between 7° plantarflexion and 12° dorsiflexion; delete "between 4° and 11°"; and the angle of inversion $\beta$ is approximately 6°. Furthermore, at heel strike the foot is typically abducted outwardly from the straight forward direction (A) at an angle $\gamma$ from 10° to 14°. In this respect, see also U.S. Pat. No. 4,439,936 to Clark et al., which is hereby incorporated by reference herein. As the ground support phase progresses, the foot is lowered to the ground in a rotative motion such that the sole comes to be placed squarely against the ground. Inward rotation of the foot is known as eversion, and in particular, inward rotation of the calcaneus associated with articulation of the sub-talar joint is known as rearfoot pronation. While eversion is itself a natural action, excessive rearfoot pronation, or an excessive rate of pronation is sometimes associated with injuries among runners and other athletes.

Referring to FIGS. 2 and 3, it is seen that the foot is interconnected to the leg via the tarsus (the posterior group of foot bones). More specifically, the tibia 1 and fibula 3 (i.e., the leg bones) are movably attached to the talus 5 to form the ankle joint. In general, the leg bones 1, 3 form a mortise into which a portion of talus 5 is received to form a hinge-type joint which allows both dorsi flexion (upward movement) and plantar flexion (downward movement) of the foot. Talus 5 overlies and is movably interconnected to the calcaneus 7 (i.e., the heel bone) to form the sub-talar joint. The sub-talar joint enables the foot to move in a generally rotative, side to side motion. Rearfoot pronation and supination of the foot is generally defined by movement about this joint. Along with talus 5 and calcaneus 7, the tarsus further includes navicular 9, cuboid 11 and the outer, middle and inner cuneiforms 13, 15 and 17. The cuboid and cuneiforms facilitate interconnection of the tarsus to the metatarsals (the middle group of foot bones). Generally, the rearfoot area is considered to extend to the junction 19 between the calcaneus 7 and cuboid 11.

As mentioned, an industry trend has been toward thickening the midsoles of athletic shoes to enhance the cushioning effect of the sole. An added thickness of foam, however, can cause the sole to have increased stiffness in bending. Under these conditions, the lateral rear corner of the sole can tend to operate as a fulcrum upon heel strike and create an extended lever arm and greater moment, which can cause the foot to rotate medially and pronate with greater velocity than is desirable. This can lead to over-pronation of the foot and possible injury. Further, this condition can present a potentially unstable condition for the foot and results in the transmission of higher than desired levels of impact stress due to the relatively small surface area of contact and the relative stiffness of a conventional sole having a higher density foam side wall, and therefore greater stiffness in the area of heel strike.

The footwear industry has wrestled with the aforementioned bio-mechanical phenomena associated with rearfoot strike for years, and various strategies have been directed towards reducing rearfoot impact shock, increasing stability and/or discouraging over-pronation.

It is known to use deep grooves, channels or slits in order to increase sole flexibility in the heel area. Two early teachings involve segmentation of a rigid sole of a street shoe, in order to reduce heel shock and to promote a more natural walking action. See Stein U.S. Pat. No. 2,629,189 and German Patent No. 680,698 to Thomsen et al. (1939). More recent teachings involving athletic shoes are disclosed in Hunt U.S. Pat. No. 4,309,832; Riggs U.S. Pat. No. 4,638,577; and Ellis PCT Applications Nos. WO 91/05491, WO 92/07483, WO 91/11924 and WO 91/19429.

Another approach taken in the prior art for minimizing the shock and overpronation associated with heel strike .involves the use of a relatively compliant midsole material in a lateral heel area and a stiffer material on a medial side. See, e.g., Cavanagh U.S. Pat. No. 4,506,462 and Bates U.S. Pat. No. 4,364,189.

The above-described segmented soles of the prior art do not adequately address the aforementioned heel strike dynamics of most runners. Typically, the application to shoe soles of grooves, slits, and materials exhibiting differential cushioning characteristics have involved excessively large heel and midfoot regions, whereby less than ideal medial and lateral stability results. In other words, the prior art has failed to properly delimit a rearfoot strike zone wherein heel strike occurs with the vast majority of runners. Through the misplacement or over placement of flex grooves or the like, medial and lateral instability in the heel and mid-foot regions can .result. Similarly, the extension of a softer sole material beyond the critical heel strike area about medial and lateral sides of the heel can adversely affect footwear stability.

It is known to incorporate into the sole of a running shoe cushioning elements including resilient inflated bladders, such as taught in the aforementioned Rudy U.S. Pat. Nos. 4,183,156, 4,340,626 and 4,219,945, and U.S. Pat. No. 4,817,304 to Parker et al. Soles incorporating gas filled bladder elements in accordance with these patents represent a great advance in athletic footwear cushioning technology. They provide a significant improvement in protection from impact stress as compared with soles formed of conventional plastic foam, by exhibiting a more linear spring characteristic throughout their range of compression and thereby transmitting lower levels of shock to a wearer during use. They also have the advantage of significantly reduced weight. Additionally, soles in accordance with the aforementioned patents have proven to be highly durable and long lasting. Conventional foam soles can break down and take on compression set after a relatively short period of usage. The inclusion of a resilient fluid bladder in the sole greatly reduces compression set due to the reduced reliance on degradable foam plastic to provide a cushioning effect.

The aforementioned Ellis PCT application No. WO 91/11924 discloses the adaptation of a conventional gas filled bladder cushioning device to a sole including spaced longitudinal deformation sipes (slits or grooves). In this embodiment, the gas-filled devices are unconnected tube-shaped chambers located in parallel and between the deformation sipes. The disclosed arrangement would provide substantially uniform flexibility and cushioning across the entire heel area, including the medial side, thus possibly resulting in a degradation of medial stability and a tendency towards over-pronation. Additionally, the longitudinal orientation of the sipes would not provide optimal articulation of the heel area to attenuate shock on rearfoot strike.

A prior art NIKE® walking shoe (the AIR PROGRESS®) has a single deep flex groove running substantially transversely across the sole in the heel area. A segmented gas filled bladder has chambers in fluid communication positioned on either side of the groove, and an area of enhanced flexibility aligned with the flex groove. This shoe advantageously provides some of the improved cushioning characteristics that a gas-filled bladder can afford, while allowing relatively unimpeded articulation about the hinge line. While this shoe works well for walking, which typically involves a heel strike centered about the longitudinal axis of the sole, the strike zone is not properly delimited to account for rearfoot strike during running. Furthermore, the sole does not provide differential cushioning in different zones to attenuate force applications and shock while at the same time enhancing stability.

It is known to incorporate into an athletic shoe relatively rigid motion control elements for controlling pronation and stabilizing the heel. For example, U.S. Pat. No. 5,046,267 to Kilgore et al. (incorporated by reference herein) discloses a plastic motion control device (FOOTBRIDGE®) incorporated into a midsole and extending across the footbed in order to gradually increase the resistance to compression of the midsole from the lateral side to a maximum along the medial side, and thereby control rearfoot pronation.

So-called heel counters are commonly incorporated into athletic and other shoes for properly positioning and providing stability to the heel and arch of the foot. Heel counters are generally formed of relatively rigid material (as compared to the primary upper and midsole materials) and extend upwardly from the sole co-extensive with a portion of the upper, in the heel area on both lateral and medial sides thereof. Typically, a heel counter will surround or cup the heel as a single rigid piece. An integrally formed rearfoot motion control device (FOOTBRIDGE®) and heel support (heel counter) is disclosed in the present Assignee's copending application Ser. No. 07/659,175 (incorporated by reference herein).

The Nike® AIR HUARACHE® has a heel counter which is split into upstanding lateral and medial panel portions affixed to the upper in the region of the heel This shoe sole has a conventional sole including a gas filled bladder, without means for providing differential cushioning and/or independent articulation between a rearfoot strike zone and a remaining heel area.

U.S. Pat. Nos. 4,445,283 and 4,297,797 to Meyers disclose the use of a relatively firm fluid fight chamber in a medial heel area of a sole and a relatively compressible chamber in a lateral heel area, so as to create greater weight bearing on the lateral side such that the medial side may form a supportive arch when the lateral side deforms. The Meyers bladder also includes a transversely extending groove or split in a midfoot region for providing flexibility. Meyers does not delimit an articulated rearfoot strike zone reflecting the dynamics and location of heel strike in most runners.

Coomer U.S. Pat. No. 4,305,212 discloses an arrangement of gas filled bladders having differential pressures in different parts of the heel area of the sole. Central lower pressure zones are surrounded by a high pressure zone extending about the rear part of the sole from a lateral to medial side, in order to capture or catch the heel in a neutral position. Due to the increased pressure in the area where heel strike will occur, less than ideal attenuation of force applications and shock on heel strike would result. Furthermore, the design does not delimit an articulated rearfoot strike zone reflecting the dynamics and location of heel strike in most runners.

SUMMARY OF THE INVENTION

In view of the foregoing, it is a principal object of the invention to provide an athletic shoe that optimizes the competing concerns of cushioning and stability associated with the ground support phase of the running cycle, and in particular rearfoot strike during running.

It is a more specific object of the invention to configure within an athletic shoe sole an articulated rearfoot strike zone and elements providing differential cushioning, so as to attenuate force applications and shock, and reduce instability associated with rearfoot strike without introducing instabilities into subsequent phases of the running cycle.

It is still another object of the invention to integrate within an athletic shoe sole an articulated rearfoot strike zone and a relatively rigid heel support element, so as to achieve the aforementioned objects while adequately supporting and positioning the heel and arch of the foot within the shoe.

It is yet another object of the invention to provide in an athletic shoe sole a segmented rearfoot strike zone delimited in such a manner as to take account of the range of rearfoot strike areas of most runners, without adversely affecting medial and lateral stability.

These and other objects are achieved by athletic footwear in accordance with the present invention. Such athletic footwear comprises an upper and a sole attached to the upper. The sole includes a cushioning midsole portion extending over a heel area of the sole. The sole has a rearfoot strike zone located at a rear lateral comer of said heel area. The rearfoot strike zone is articulated in relation to the remaining heel area about a line of flexion delimiting the rearfoot strike zone. The midsole portion comprises differential cushioning means for reducing the compressive stiffness of the midsole portion within the rearfoot strike zone, relative to at least a medial side of the remaining heel area. The differential cushioning means includes a resilient fluid bladder chamber positioned within the rearfoot strike zone.

In another aspect, athletic footwear in accordance with the present invention comprises an upper, a sole attached to the upper, and a relatively rigid heel support member incorporated into the sole. The sole includes a cushioning midsole portion extending over a heel area of the sole, and has a rearfoot strike zone located at a rear lateral comer of the heel area. The rearfoot strike zone is articulated in relation to the remaining heel area about a line of flexion delimiting the rearfoot strike zone. The heel support member comprises separate lateral and medial segments extending upwardly coextensive with a portion of the upper in the heel area on lateral and medial sides thereof, respectively. The lateral and medial segments are articulated in relation to each other through the midsole portion, whereby the heel support member does not significantly impede articulation of the rearfoot strike zone about the line of flexion.

In yet another aspect, athletic footwear in accordance with the present invention comprises an upper and a sole attached to the upper. The sole includes a cushioning midsole portion extending over a heel area of said sole and a line of flexion delimiting a rearfoot strike zone at a rear lateral comer of the heel area. The line of flexion extends from a first end located along a rear medial side of the sole to a second end located along a lateral side of the sole, The second end is adjacent to or rearward of a nominal location of the junction of the calcaneus and cuboid bones of the foot. The first end is located such that a line drawn from a nominal location of the weight bearing center of the heel to the first end forms a 10° to 50° angle with a central longitudinal axis of the sole. The rearfoot strike zone is articulated with respect to the remaining heel area about the line of flexion. The midsole portion comprises a resilient segmented fluid bladder having a first chamber positioned within the rearfoot strike zone and a second chamber extending within the remaining heel area. The first chamber and second chamber are articulated in relation to each other through a relatively flexible bladder portion forming, at least in part, the line of flexion.

In still another aspect, athletic footwear in accordance with the present invention comprises an upper and a sole attached to the upper. The sole includes a cushioning midsole portion extending over a heel area of said sole, and a rearfoot strike zone located at a rear lateral comer of said heel area. The rearfoot strike zone is articulated in relation to the remaining heel area along a line of flexion delimiting the rearfoot strike zone. The midsole portion comprises a segmented fluid bladder having a first chamber located within the rearfoot strike zone, a second chamber extending within a central portion of the remaining heel area, about a nominal location of the weight bearing center of the heel, and a third chamber extending along a medial side portion of said remaining heel area. The first chamber is articulated with respect to each of said second and third chambers through a relatively flexible bladder portion connecting the first chamber with at least one of the second and third chambers. The line of flexion is formed along the relatively flexible bladder portion. The first chamber exhibits a lesser compressive stiffness than said third chamber, whereby enhanced cushioning is obtained in the rearfoot strike zone while maintaining medial stability.

These and other more specific objects and features of the present invention will be apparent and fully understood from the following detailed description of the preferred embodiments, taken in connection with the appended drawings.

DETAILED DESCRIPTION OF THE PREFERRED EMBODIMENTS

The rearfoot strike zone of the invention is a portion of the heel area of the sole delimited by a line of flexion about which the rearfoot strike zone is articulated in relation to the remaining heel area. "Line of flexion" as used herein refers to a line of action, rather than a physical element of the sole per se, about which articulation of the rearfoot strike zone occurs. Independent articulation of the strike zone increases the surface area of ground contact occurring at heel strike from a narrow edge-like strip extending along the rear lateral sidewall of the sole to a wider planar area extending inwardly of the sidewall. This results in increased stability, enhanced attenuation of force applications and shock, and a reduced medial moment. Attenuation of the shock associated with heel strike is also enhanced by the provision of means for reducing the compressive stiffness of the midsole within the rearfoot strike zone.

Figure 1:
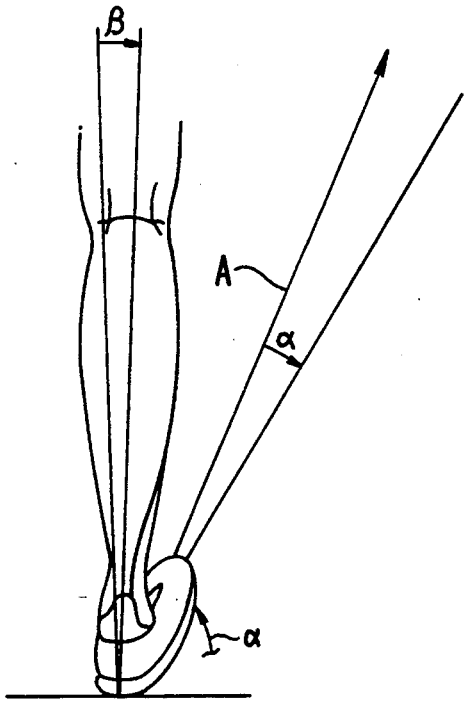
FIG. 1 is a diagrammatic view illustrating a typical orientation of the foot at heel strike.

A primary objective in the placement of the line of flexion is to properly delimit a rearfoot strike zone having enhanced cushioning. The rearfoot strike zone should encompass the range of heel strike locations for most runners, without adversely affecting medial and lateral stability during the braking and propulsive portions of the ground support phase. The orientation of the foot at heel strike is described in the background section and shown in FIG. 1. This orientation places the area of rearfoot strike (during running) for most persons within a range about the rear lateral comer of the sole. Hence, the rearfoot strike zone should be positioned in this area.

Figure 3:
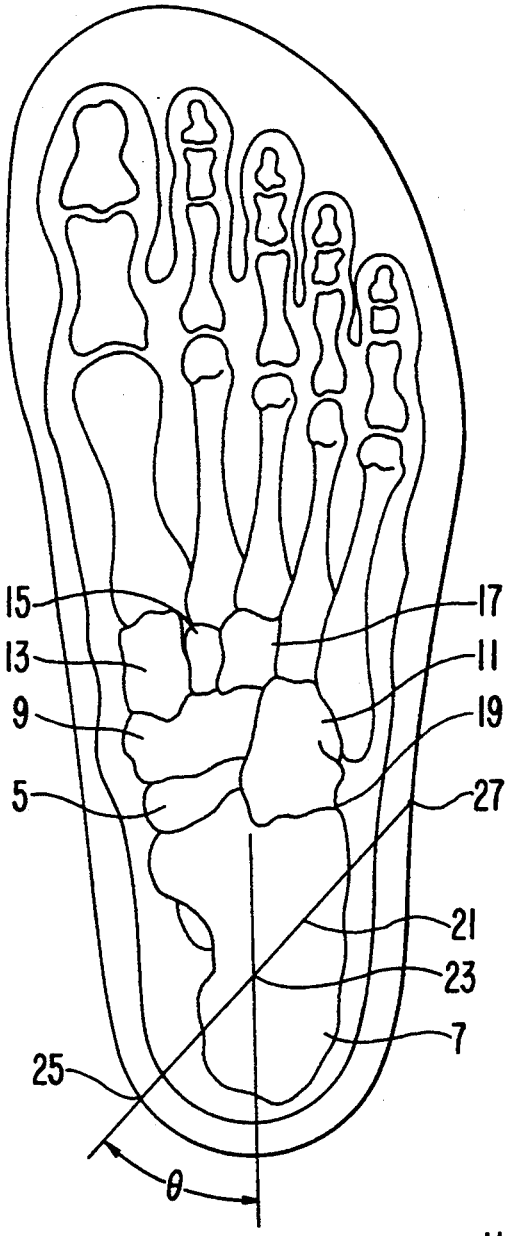
FIG. 3 is a bottom or plantar view of the bones of the human foot, superimposed within a diagrammatic illustration of a shoe sole in accordance with the present invention.

FIG. 3 illustrates diagrammatically a line of flexion 21 delimiting a rearfoot strike zone in accordance with the present invention. On the lateral side, there is no need for the rearfoot strike zone to extend beyond the junction 19 of the calcaneus 7 and cuboid 11 bones of the foot—generally considered to be the limit of the rearfoot area. In :fact, it has been observed that rearfoot strike generally occurs well rearward of this point so that the rearfoot strike zone may be shortened accordingly. Extension of a more compliant rearfoot strike zone in accordance with the present invention, beyond the junction 19 of the calcaneus and cuboid could begin to degrade lateral stability in the midfoot region, particularly during stance and the early stages of the propulsive portion of ground support phase, and particularly for those exhibiting a propensity for over-supination (an excessive rolling of the foot outward toward the lateral side).

Figure 2:
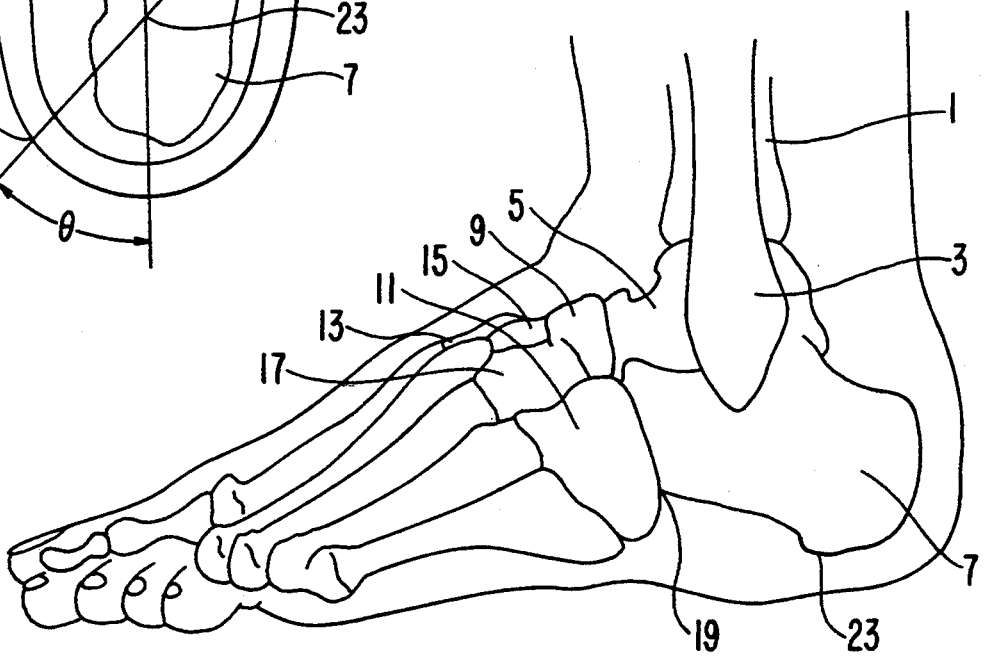
FIG. 2 is a lateral side view of the bones of the human foot.
Figure 4:
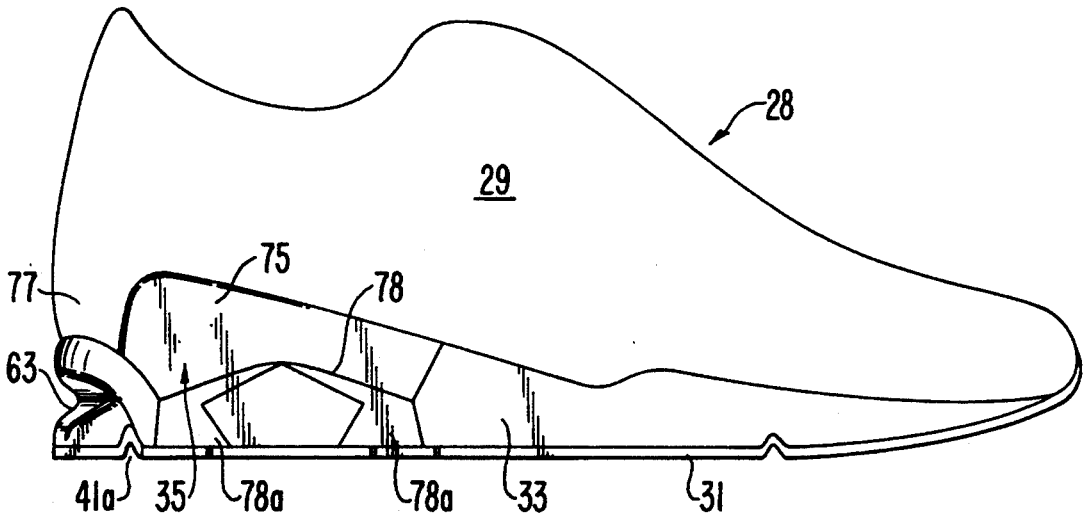
FIG. 4 is a medial side view of a shoe in accordance with the present invention.
Figure 5:
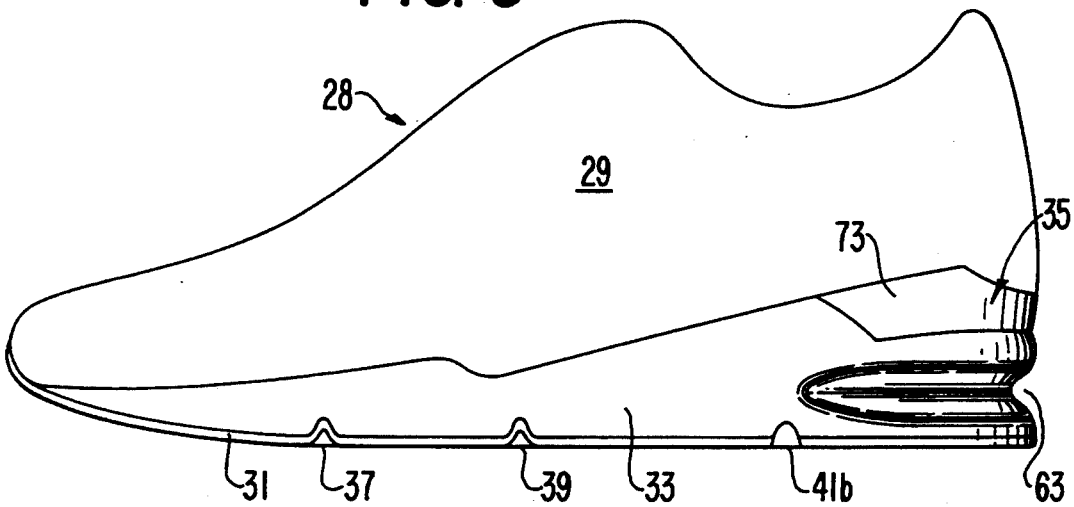
FIG. 5 is a lateral side view of the shoe shown in FIG. 4

The rearfoot strike zone generally need only extend toward the medial side a short distance beyond the longitudinal center of the rear side of the heel in order to accommodate the heel strike of most runners. The medial side termination point of the rearfoot strike zone is conveniently described in relation to the weight bearing center of the heel, i.e., the nominal location of the apex of the plantar surface of the calcaneus, (labeled 23 in FIGS. 2 and 3). More specifically, the medial side termination point may be described in terms of the angle Θ formed between a longitudinal center axis of the sole and a line drawn from the weight bearing center 23 of the heel to the termination point. Placement of the medial side termination point of the rearfoot strike zone so as to create an angle Θ of 10° is satisfactory to accommodate the heel strike of many runners. The angle Θ may be increased from 10° up to 50° for greater inclusiveness of the range of possible heel strikes. However, extension of a more compliant rearfoot strike zone in accordance with the present invention, beyond this point, will begin to degrade medial stability, particularly for those runners exhibiting a tendency towards over-pronation.

Again "line of flexion" as used herein refers to a line of action, rather than a physical element of the sole per se, about which articulation of the rearfoot strike zone occurs. The location and path of line of flexion 21 are determined by physical elements of the sole (to be described hereinafter) that cooperate to provide a relatively independent articulation of the rearfoot strike zone relative to the remaining heel area. By delimiting the rearfoot strike zone with a relatively flexible border (a "line of flexion"), increased compliance within the strike zone is obtained since the strike zone is able to pivot as a whole in addition to compressing. In contrast, the cushioning action of a strike zone comprising a softer material but lacking a defined line of flexion may be compromised by resistance to bending of the sole associated with deflection of the strike zone. The provision of a line of flexion in accordance with the present invention allows the compliance of the rearfoot strike zone to be enhanced.

Line of flexion 21 is shown in FIG. 3 with its ends at the outer limits of the preferred ranges of the rearfoot strike zone, as described above. This location provides maximum inclusiveness of the range of possible heel strike locations without degrading lateral and medial stability. A first (medial) side end 25 of fine 21 is located such that a line drawn from a nominal (average) location of the weight bearing center 23 of the heel to the first end 25 forms a 50° angle with respect to a central longitudinal axis of the sole. A second (lateral) side end 27 of line 21 is located adjacent to a nominal location of the junction 19 of the calcaneus 7 and cuboid 11. Although line of flexion 21 is shown to extend linearly between first and second ends 25, 27, and to intersect with heel center 23, this is not necessarily the case. Line of flexion 21 may be arcuate along part or all of its length, and may be moved rearwardly in accordance with the guidelines set forth above for delimiting the rearfoot zone. A generally linear path between ends 25 and 27 is preferred in order to provide effective articulation of the rearfoot strike zone at heel strike.

A first shoe embodiment 28 in accordance with the present invention is illustrated in FIGS. 4–9. The shoe comprises a conventional upper 29, and a sole attached to the upper. The sole comprises an outsole 31 of wear resistant material, a cushioning midsole 33, and a motion control element 35.

A plurality of flex joints are formed in the sole. In the forefoot region, a set of flex grooves 37, 39 extend transversely across the sole. Two aligned flex grooves 41*a*, 41*b* are provided in the rearfoot region, and it is along these flex grooves that line of flexion 21 is formed. In this embodiment, flex grooves 41*a*, 41*b* constitutes two features of the sole serving to define the path and location of line of flexion 21, and thereby delimit rearfoot strike zone 43.

The flex joints in the sole can be formed in a number of different ways. For instance, outsole 31 and midsole 33 may cooperatively form the flex joints as grooves having a V-shape in cross-section, as shown in FIGS. 4–8. Furthermore, all or some of the flex grooves may vary in depth along their lengths, as do flex grooves 41*a*, 41*b*. FIGS. 10–13 illustrate clearly various possible flex joint constructions.

Figure 10:
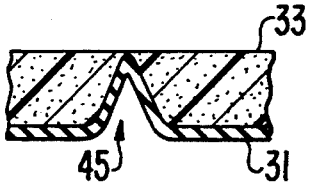
FIGS. 10–13 are partial cross-sectional views illustrating various alternative flex joint constructions.
Figure 11:
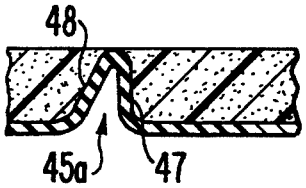
Figure 12:
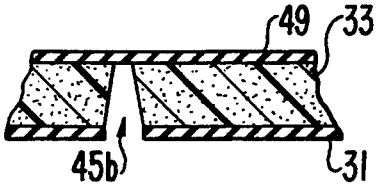
Figure 13:
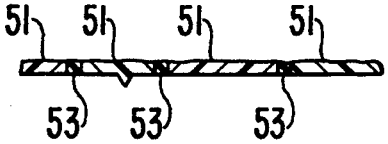

In FIG. 10, flex groove 45 has the V-shaped cross-section construction shown in FIGS. 4–8. Alternatively, the flex joints could be formed as grooves having other shapes, such as groove 45*a* shown in FIG. 11 According to this embodiment, groove 45*a* is defined by an upright wall 47 and an inclined wall 48. This type of groove may be useful if a greater freedom of movement is desired relative to the side of the groove adjacent inclined wall 47. The flex joints may also be formed as grooves 45*b* which are defined by simply removing or omitting a portion of the outsole 31 and midsole 33, as seen in FIG. 12. Grooves 45*b* could be left open or filled partially or wholly with a highly elastic and flexible material. As shown in FIGS. 10–12, the grooves may be deep troughs which extend substantially through the sole in order to provide maximum flexibility. In the embodiment of FIG. 12, layer 49 may be a textile material such as KEVLAR® adhered to the midsole and functioning as the insole or as a support for the insole. Further, the textile material can comprise an elastic material.

Additionally, the flex joints may be formed by providing a weakened construction or a material of greater elasticity and flexibility. One example of this type of construction is disclosed in co-pending commonly owned application Ser. No. 07/986,046 to Lyden et al., entitled CHEMICAL BONDING OF RUBBER TO PLASTIC IN ARTICLES OF FOOTWEAR (incorporated by reference herein). According to this construction at least a portion of the sole would be formed by a mosaic of plastic plates 51 bound together by a rubber material 53. The location of the rubber would correspond to the flex joints. Alternatively, a strip of relatively flexible material could be incorporated into a midsole having a conventional outsole attached thereto.

Figure 6:
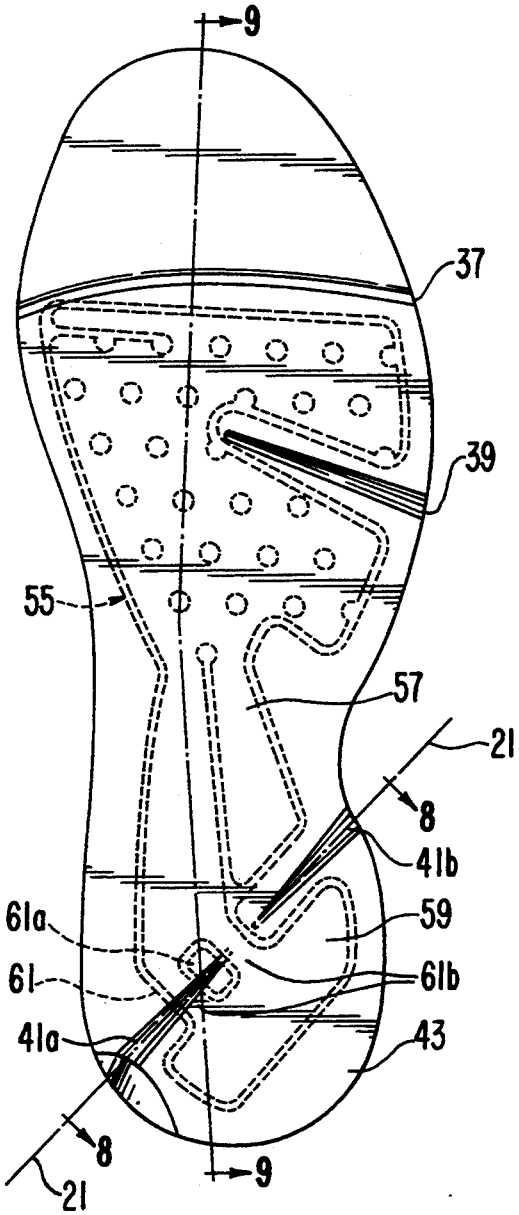
FIG. 6 is a bottom plan view of the sole of the shoe shown in FIG. 4, illustrating in phantom a segmented resilient fluid bladder in accordance with the present invention.
Figure 7:
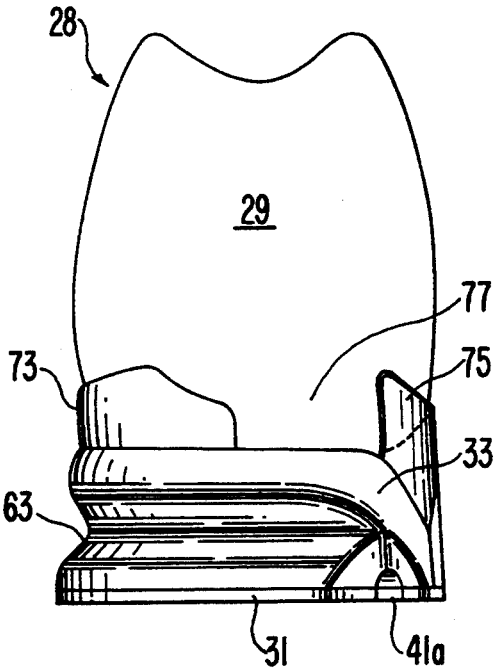
FIG. 7 is a rear elevational view of the shoe shown in FIG. 4.
Figure 8:
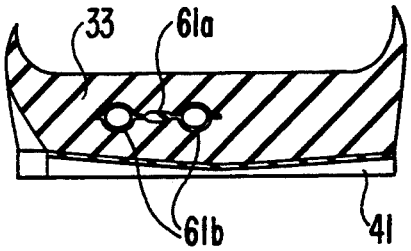
FIG. 8 is a cross-sectional view taken on section line 8—8 in FIG. 6.
Figure 9:
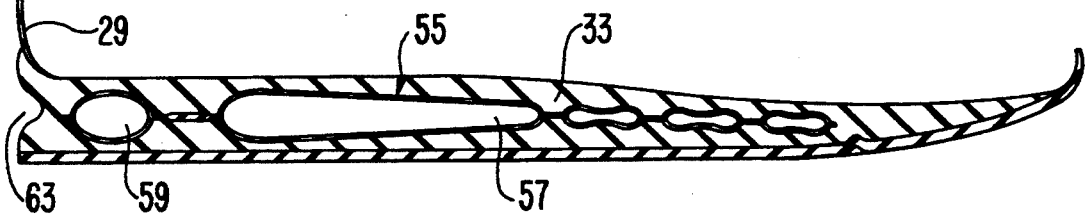
FIG. 9 is a cross-section view taken on section line 9—9 in FIG. 6

Referring now to FIGS. 6, 8 and 9, midsole 33 is formed of a cushioning, resilient foam material such as polyurethane foam and has encapsulated therein a segmented resilient gas-filled bladder 55. Bladder 55 is preferably generally formed in accordance with the teachings of the Rudy patents mentioned in the background section and incorporated herein by reference.

Bladder 55 has a large chamber 57 extending from the forefoot region of the sole to the rearfoot area outside of rearfoot strike zone 43. A second smaller chamber 59 of bladder 55 is located within rearfoot strike zone 43 and comprises a major part (more than half) of the midsole portion therein. Chambers 57 and 59 are connected and articulated with respect to each other through a relatively flexible bladder portion 61 acting as a hinge. As shown, flexible bladder portion 61 comprises a weld seam 61*a* and a pair of passageways 61*b* placing chambers 57 and 59 in fluid communication with each other. Flexible bladder portion 61 is aligned with flex grooves 41*a*, 41*b*, such that these elements cooperate with each other to locate line of flexion 21 therealong. In this manner, rearfoot strike zone 43 is delimited by line of flexion 21 and articulated in relation to the remaining heel area.

The provision of a line of flexion 21, in accordance with the present invention, affords a greater compliance to rearfoot strike zone 43, whereby the surface area of initial ground engagement is increased. Furthermore, cushioning is enhanced in the rearfoot strike zone by decreasing the compressive stiffness of midsole 33 within rearfoot strike zone 43. This can be accomplished in one or more of several different ways. In the embodiment of FIGS. 4–9, midsole 33 is formed with a concave sidewall channel 63 extending along rearfoot strike zone 43. By omitting a significant amount of midsole material from along the edge of rearfoot strike zone 43, the compressive stiffness of the rearfoot strike zone 43 is decreased relative to the remaining heel area.

Alternatively, instead of placing chambers 57 and 59 in fluid communication with each other and hence at equal inflation pressures, chambers 57 and 59 could be fluidically isolated from each other, e.g., by extending weld 61*a* across the areas of fluid passageways 61*b* Chamber 59 could then be inflated to a lower pressure than chamber 57 in order to provide less compressive stiffness of midsole 33 within rearfoot strike zone 43.

Figure 14:
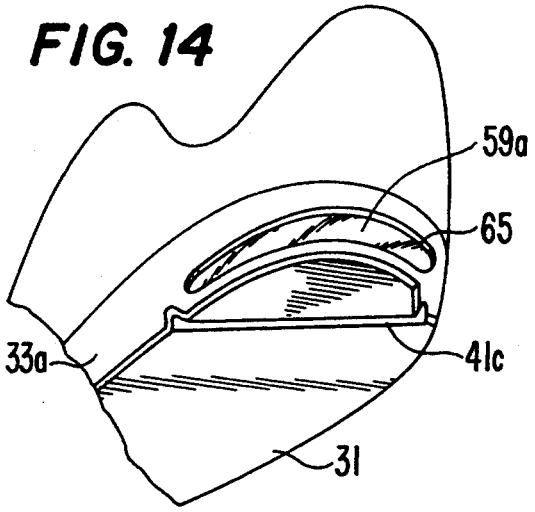
FIG. 14 is a partial perspective view of the rearfoot area of a shoe, illustrating alternative features of the present invention.

The invention is by no means limited to the illustrated configuration of segmented bladder 55. For example, bladder chamber 59 could be modified to comprise a smaller or larger part of midsole 33 within rearfoot strike zone 43. As shown in FIG. 14, a modified bladder chamber 59*a* could be configured to cooperate with a gap 65 in the sidewall of a midsole 33*a* to form a visco-elastic unit. In such a configuration, bladder chamber 59*a* would flex into gap 65 during rearfoot strike, such that the compressive stiffness of chamber 59*a* would be decreased. In this view, a modified flex joint 41*c* comprises a single continuous groove.

Figure 15:
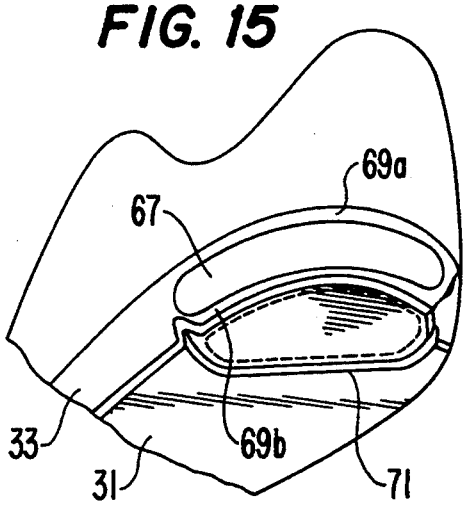
FIG. 15 is a partial perspective view of the rearfoot area of a shoe, illustrating further alternative features in accordance with the present invention.
Figure 16:
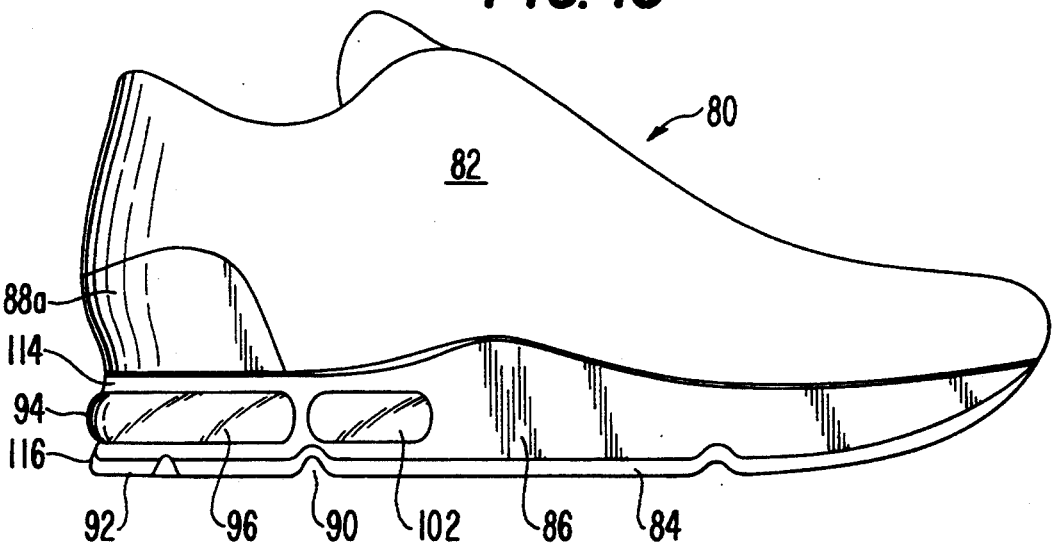
FIG. 16 is a lateral side view of a shoe illustrating another embodiment of the present invention.
Figure 17:
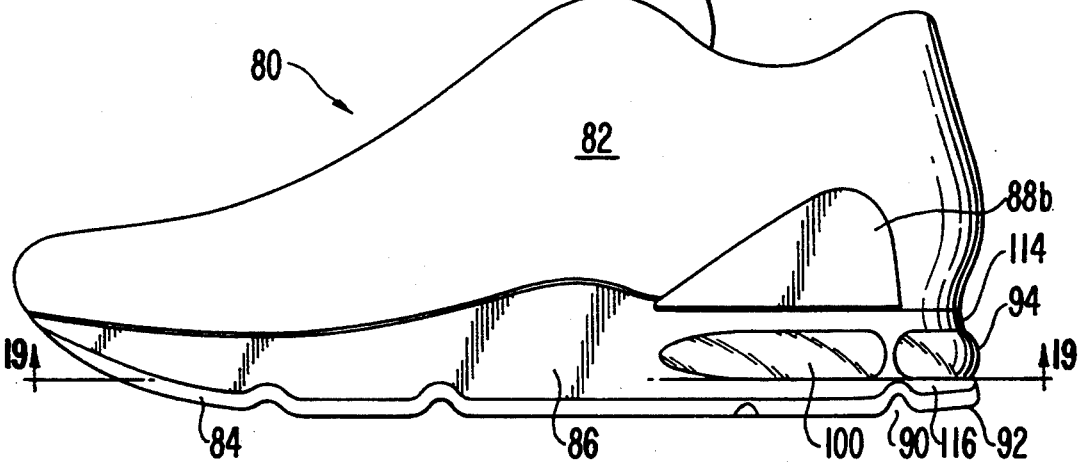
FIG. 17 is a medial side view of the shoe shown in FIG. 16.

Bladder chamber 59 could be provided entirely separate from bladder chamber 57, or bladder chamber 57 could be omitted entirely. The latter variation is illustrated in FIG. 15. In this embodiment, a single fluid bladder 67, which may be a single chamber or multi-chamber bladder, comprises almost the entire portion of midsole 33 within the rearfoot strike zone. As shown, thin layers 69*a*, 69*b* of midsole material, e.g., plastic foam, encapsulate the upper and lower surfaces of bladder 67. A sidewall portion of bladder 67 is substantially wholly exposed between the first and second ends of the arcuate line of flexion defined by arcuate groove 71. In this manner, the sidewall of bladder 67 forms a flexible sidewall of midsole 33 within the rearfoot strike zone.

In a further possible modification, thin layers 69*a*, 69*b* could be omitted and bladder 67 bonded directly to the shoe upper or insole and outsole 31. Furthermore, in this embodiment it would be desirable to provide a relatively flexible juncture between bladder chamber 67 and the adjoining midsole material within the remaining heel area. Such a juncture might, for example, be formed by a line of highly elastic and flexible midsole material.

The preferred embodiment of FIGS. 4–9 integrates with articulated rearfoot strike zone 43 a motion control device 35 comprising a heel support member (heel counter) having lateral and medial segments 73, 75. Motion control device 35 is preferably formed of a relatively rigid and incompressible plastic material. Heel counter segments 73, 75 extend upwardly coextensive with a portion of upper 29 in the heel area, on lateral and medial sides thereof. Lateral segment 73 extends rearwardly to the center of the heel. On the other hand, medial segment 75 terminates just above the medial side end of flex groove 41*a*, such that a vertical line passing through the end of groove 41*a* (and line of flexion 21 coincident therewith) passes through or adjacent to a gap 77 formed between segments 73, 75. Whereas a single piece rigid heel counter extending about the back of the heel area could tend to rigidify the heel area and impede independent articulation of rearfoot strike zone 43, the provision of a split heel counter in accordance with the present invention allows articulation of rearfoot strike zone 43 to go unimpeded. At the same time, the benefits of stability that a heel counter can provide may be realized.

In the illustrated preferred embodiment, medial counter segment 75 is formed integrally with a rearfoot motion control device 78 (see FIG. 4) of the same general type as is disclosed in the Kilgore et al. patent mentioned in the background section and incorporated by reference herein. Similar to the Kilgore et al. device, motion control device 78 comprises two generally vertically extending rigid supports 78*a*, 78*b* affixed to midsole 33. Extending between supports 78*a*, 78*b* along the top medial edge of midsole 33 is a common base (not shown) providing a cantilever support for a plurality of plate-like finger elements (not shown) extending horizontally across the footbed. Motion control device 78 is configured in accordance with the teachings of .Kilgore et al. in order to gradually increase the resistance to compression of the midsole from the lateral side to a maximum along the medial side, to thereby control rearfoot pronation. Motion control device 78 should be located entirely outside of rearfoot strike zone 43 so that the articulation of and cushioning within the rearfoot strike zone remains unaffected.

A further embodiment of the invention is illustrated in FIGS. 16–20. Like the shoe of FIGS. 1–9, shoe 80 comprises a conventional upper 82, and a sole attached to the upper. The sole comprises an outsole 84 of wear resistant material, a cushioning midsole 86, and a split heel counter having lateral and medial segments 88*a*, 88*b*.

A plurality of flex grooves are formed in the sole, including a groove 90 extending across the sole in the heel area and serving to define a line of flexion 21' (see FIG. 20) delimiting an articulated rearfoot strike zone 92. These flex joints may take any of the forms previously described. The medial and lateral limits of rearfoot strike zone 92 are within the range of preferred limits previously described. The split of the heel counter is coordinated with the line of flexion 21' in accordance with the description of the first embodiment, so as not to impede the articulation of rearfoot strike zone 92.

Midsole 86 encapsulates within the rearfoot area a segmented resilient gas-filled bladder 94 having a plurality of chambers which may exhibit different stiffnesses. More specifically, referring to FIGS. 19 and 20, bladder 94 comprises a first chamber 96 located within the rearfoot strike zone 92, a second chamber 98 extending within a central portion of the remaining heel area, about a nominal location of the weight bearing center of the heel, a third chamber 100 extending along a medial side portion of the remaining heel area, and a fourth bladder chamber 102 extending along a lateral side of the remaining heel area.

Chambers 96–102 are shown connected to each other by a relatively flexible web portion 104 extending therebetween. Such a web may be formed integrally with the chambers by blow-molding. Alternatively, bladder 94 may be formed by welding the appropriate divisions between the chambers using a conventional technique.

Figure 20:
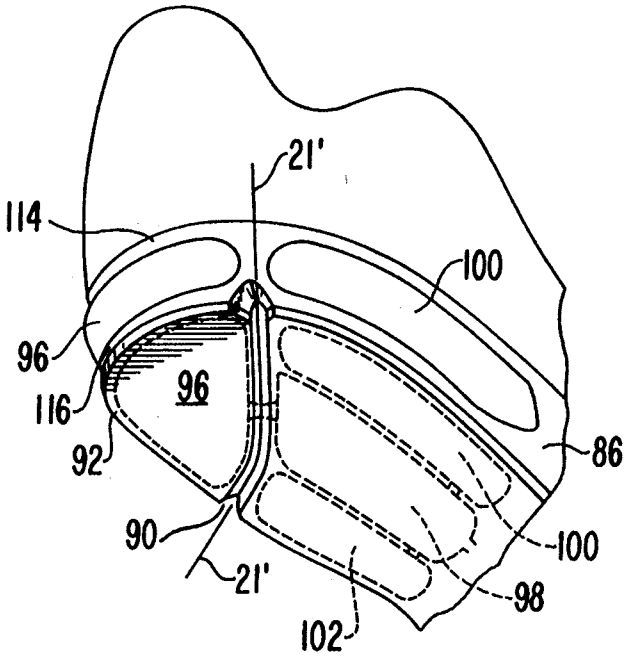
FIG. 20 is a partial perspective view of the rearfoot area of the shoe shown in FIG. 16.
Figure 19:
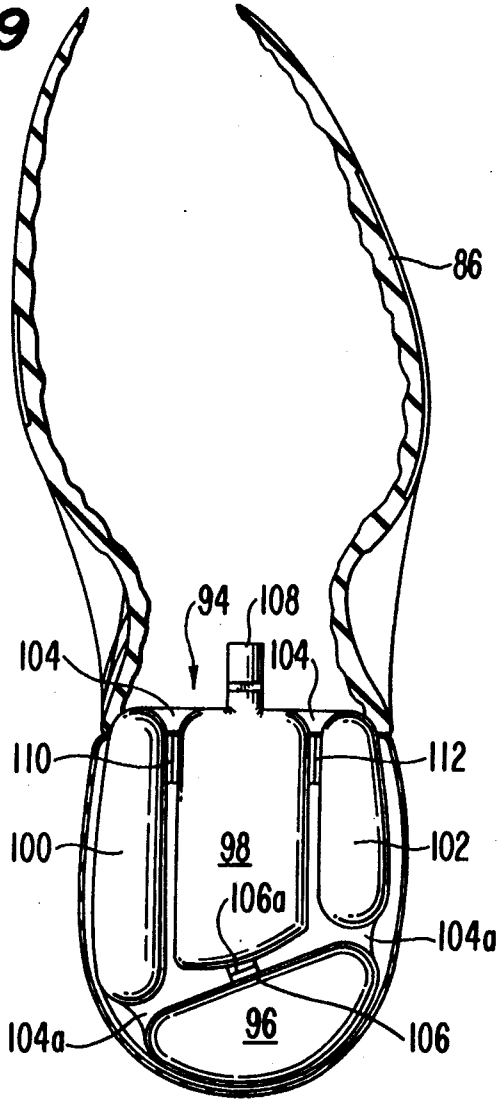
FIG. 19 is a cross-sectional view taken on line 19—19 in FIG. 17.
Figure 18:
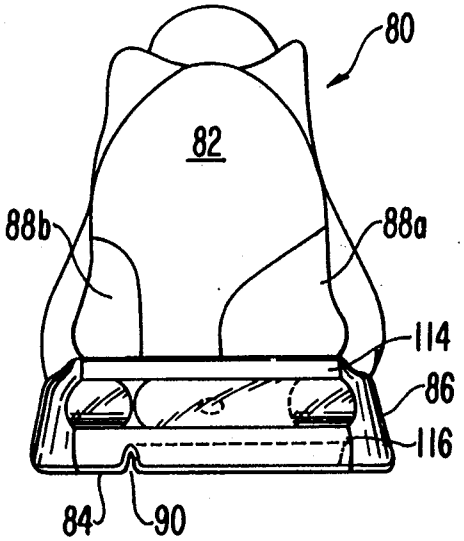
FIG. 18 is a rear elevational view of the shoe shown in FIG. 16.

A flexible joint is not necessary between bladder chambers 98, 100 and 102. It is however advantageous to provide a relatively flexible joint between first bladder chamber 96 and the other chambers so as to allow unimpeded articulation of rearfoot strike zone 92 relative to the remaining heel area. In this embodiment, the relatively flexible bladder portion 104*a* connecting bladder 96 to the other chambers, and flex groove 90 aligned therewith, cooperate to determine the path and location of line of flexion 21'. As best seen in FIG. 20, line of flexion 20' is arcuate along a portion of its length, so as to accommodate the rounded medial corners of chambers 96 and 102.

Flexible web 104*a* need not extend the entire length from the medial to lateral side along chamber 96. For increased flexibility, it may be desirable to remove or omit portions of web 104*a*, e.g., leaving chamber 96 connected only to central chamber 98. Furthermore, a void in the encapsulating midsole material may be provided along web 104*a* for increasing flexibility and to avoid localized stiffness in compression.

Fluid bladder 94 advantageously allows differential inflation pressures and hence stiffnesses to be provided in different parts of the rearfoot area, so that the cushioning characteristics of the heel can be optimized. In accordance with the present invention, the medial and lateral side chambers 100, 102 are preferably inflated to a pressure of between 15 and 50 psi, and most preferably between 20 and 25 psi. Chamber 96 in the rearfoot strike zone is preferably inflated to a pressure of between 1 and 10 psi, and most preferably between 1 and 5 psi. Tests have indicated that with the medial side chamber 100 inflated to 25 psi and rearfoot strike zone chamber 96 inflated to 5 psi, chamber 96 will exhibit roughly half of the compressive stiffness of chamber 100.

The compressive stiffness of the central rearfoot area is preferably also lowered in relation to the stiffness on the lateral and medial sides. This can provide enhanced cushioning without adversely affecting lateral and medial stability. Accordingly, it is preferable to inflate central chamber 98 to a pressure of between 1 and 10 psi, and most preferably between 1 and 5 psi. In order to maintain chambers 98 and 96 at equal pressures, these chambers can be kept in fluid communication through a passageway 106 extending through flexible web 104*a*. Alternatively, passageway 106 can be sealed off by a weld fine 106*a* to isolate chambers 96 and 98, in which case the pressure in chamber 96 could be made lower or higher.

The manner of inflating bladder 94 is now briefly described. The entire bladder is inflated through flexible stem 108, with all of the chambers initially in fluid communication with each other. Fluid communication between chambers 96 and 98 is provided through passageway 106 as previously described. Similar fluid passageways 110 and 112 connect chambers 98, 100 and 102.

Initially, the entire bladder 94 is inflated to the maximum desired chamber pressure. Then the chamber(s) in which it is desired to maintain the maximum pressure, e.g. , medial side chamber 100 and lateral side chamber 102, are sealed off by welding across the appropriate fluid passageways. Then, pressure can be bled through stem 108 until the desired lower pressures are obtained in the remaining chambers. Next, these chambers are sealed in a similar manner, with the final weld being placed across stem 108 to seal chamber 98.

The basic concept of segmented bladder 94 can be applied equally to segmented bladders of various configurations. For example, the number of separate bladder chambers and the shapes and sizes thereof may be varied. In particular, if it is desired to adjust the line of flexion 21' within the preferred range described herein, the bladder configuration can be changed accordingly. Furthermore, bladder 94 need not be restricted to the rearfoot area but may extend into portions of the midfoot and forefoot regions. Conversely, the bladder chambers could occupy a lesser portion of the rearfoot strike zone and remaining heel area.

In the particular embodiment illustrated in FIGS. 16–20 relatively thin layers 114, 116 of midsole material encapsulate the upper and lower surfaces of bladder 94. The side wall portions of bladder 94 are thus substantially wholly exposed to form a flexible generally transparent sidewall along the medial, rear and lateral sides of the midsole rendering at least a portion of the internal structure of the sole visible. Alternatively, bladder 94 could be wholly encapsulated or bonded directly between the upper or insole and the outsole without encapsulating layers.

Furthermore it can be readily understood that any resilient gas fried bladder utilized in the practice of the invention may be stock-fit rather than encapsulated.

The invention has been described in terms of presently preferred embodiments thereof. Other embodiments and modifications within the scope and spirit of the invention will, given this disclosure, occur to persons skilled in the art.

We claim:

1. Athletic footwear comprising an upper and a sole attached to said upper;

said sole including a cushioning portion extending over a heel area of said sole and a line of flexion delimiting a rearfoot strike zone at a rear lateral comer of said heel area, said line of flexion extending from a first end located along a rear medial side of the sole to a second end located along a lateral side of the sole, said second end being adjacent to or rearward of a nominal location of the junction of the calcaneus and cuboid bones of the foot, said first end being located such that a line drawn from a nominal location of the weight bearing center of the heel to said first end forms a 10° to 50° angle with a central longitudinal axis of the sole, said rearfoot strike zone being articulated with respect to the remaining heel area about said line of flexion;

said cushion portion comprising a resilient segmented substantially gas-filled bladder having a first chamber positioned within said rearfoot strike zone and a second chamber extending within said remaining heel area, said first chamber and second chamber being articulated in relation to each other through a relatively flexible bladder portion, said flexible bladder portion being aligned with a groove opening to a bottom surface of said sole, said groove extending at least part way into a midsole of said of said sole, and said line of flexion being formed along said relatively flexible bladder portion and said groove.

2. Athletic footwear according to claim 1, wherein said first and second chambers are fluidically isolated from each other, and said first chamber has a lower fluid pressure than said second chamber, whereby the compressive stiffness of said first chamber is decrease to said second chamber.

3. Athletic footwear according to claim 1, wherein said groove varies in depth along its length.

4. Athletic footwear according to claim 3, wherein a line of flexion is also formed along at least two separate grooves opening to a bottom surface of said sole and extending at least partway into said midsole portion of said sole.

5. Athletic footwear according to claim 1, wherein said line of flexion is also formed along a line of relatively flexible material provided within a midsole portion of said sole.

6. Athletic footwear according to claim 1, wherein said line of flexion extends linearly between said first and second ends thereof.

7. Athletic footwear according to claim 1, wherein said fine of flexion is arcuate along at least a portion of its length.

8. Athletic footwear according to claim 1, wherein said first chamber comprises a major part of a midsole portion within the rearfoot strike zone.

9. Athletic footwear according to claim 8, wherein said first chamber is encapsulated by midsole material forming a midsole sidewall along said rearfoot strike zone, said sidewall having a gap into which said first chamber can flex during rearfoot strike, whereby the compressive stiffness of said first chamber is decreased relative to said second chamber.

10. Athletic footwear according to claim 9, wherein said gap extends substantially between said first and second ends of the line of flexion.

11. Athletic footwear according to claim 8, wherein said first chamber has a sidewall portion which is substantially wholly exposed between said first and second ends of the line of flexion to form a flexible sidewall of the midsole portion.

12. Athletic footwear according to claim 11, wherein said second chamber has a sidewall portion which is substantially wholly exposed to form a flexible sidewall of the midsole portion extending along said remaining heel area.

13. Athletic footwear according to claim 1, wherein said first chamber is encapsulated by midsole material forming a midsole sidewall along said rearfoot strike zone, said sidewall forming a channel along said rearfoot strike zone serving to further reduce the compressive stiffness of the rearfoot strike zone relative to the remaining heel area.

14. Athletic footwear comprising an upper and a sole attached to said upper;

said sole including a cushioning portion extending over a heel area of said sole, and a rearfoot strike zone located at a rear lateral corner of said heel area, said rearfoot strike zone being delimited in relation to the remaining heel area by a line extending from a first end located along a rear medial side of the sole to a second end located along a lateral side of the sole, said second end being adjacent to or rearward of a nominal location of the junction of the calcaneus and cuboid bones of the foot, and said first end being located such that a line drawn from a nominal location of the weight bearing center of the heel to said first end forms a 10° to 50° angle with central longitudinal axis of the sole;

said cushioning portion comprising a first substantially gas-filled bladder chamber extending within said rearfoot strike zone, a second substantially gas-filled bladder chamber extending within a central portion of said remaining heel area, about and below a nominal location of the weight bearing center of the heel, and a third substantially gas-filled bladder chamber extending along a medial side portion of said remaining heel area;

said first chamber exhibiting a lesser compressive stiffness than said third chamber.

15. Athletic footwear according to claim 14, wherein said first chamber is inflated to a pressure of between 1 and 10 psi, and said third chamber is inflated to a pressure of between 15 and 50 psi.

16. Athletic footwear according to claim 15, wherein said third chamber is inflated to a pressure of between 20 and 25 psi.

17. Athletic footwear according to claim 15, wherein said first chamber is inflated to a pressure of between 1 and 5 psi.

18. Athletic footwear according to claim 14, wherein said first and second fluid chambers are in fluid communication with each other.

19. Athletic footwear according to claim 18, wherein said first and second chambers are inflated to a pressure of between 1 and 10 psi and said third chamber is inflated to a pressure of between 15 and 50 psi.

20. Athletic footwear according to claim 19, wherein said third chamber is inflated to a pressure of between 20 and 25 psi.

21. Athletic footwear according to claim 19, wherein said first and second chambers are inflated to a pressure of between 1 and 5 psi.

22. Athletic footwear according to claim 14, wherein said first and second chambers are fluidically isolated from each other, and said first chamber is inflated to lower pressure than said second chamber.

23. Athletic footwear according to claim 14, wherein said cushioning portion further comprises a fourth bladder chamber extending along a lateral side of the sole outside of said rearfoot strike zone, said first bladder chamber exhibiting a lesser compressive stiffness than said fourth bladder chamber.

24. Athletic footwear according to claim 23, wherein said first chamber is inflated to a pressure of between 1 and 10 psi, and said fourth chamber is inflated to a pressure of between 15 and 50 psi.

25. Athletic footwear according to claim 24, wherein said third chamber is inflated to a pressure of between 20 and 25 psi.

26. Athletic footwear according to claim 24, wherein said first chamber is inflated to a pressure of between 1 and 5 psi.

27. Athletic footwear according to claim 14, wherein said first and third chambers are fluidically isolated from each other, and said first chamber is inflated to a lower pressure than said third chamber.

28. Athletic footwear according to claim 14, wherein said first, second and third bladder chambers form parts of a unitary segmented bladder having a relatively flexible connecting portion connecting said bladder chambers, said first bladder chamber being articulated with respect to each of said second and third bladder chambers through said relatively flexible connecting portion.

29. Athletic footwear comprising an upper, a sole attached to said upper, and a relatively rigid heel support member incorporated into said sole;

said sole including a cushioning portion extending over a heel area of said sole, and a rearfoot strike zone located at a rear lateral corner of said heel area, said rearfoot strike zone being articulated in relation to the remaining heel area about a line of flexion delimiting said rearfoot strike zone;

said heel support member comprising separate lateral and medial segments extending upwardly coextensive with a portion of said upper in said heel area on lateral and medial sides thereof, respectively, said lateral and medial segments being articulated in relation to each other through said cushioning portion;

wherein:

said line of flexion extends from a first end located along a rear medial side of the sole to a second end located along a lateral side of the sole, said second end being adjacent to or rearward of a nominal location of the junction of the calcaneus and cuboid bones of the human foot, and said first end being located such that a line drawn from a nominal location of the weight bearing center of the heel to said first end forms a 10° to 50° angle with respect to a central longitudinal axis of the sole;

a gap is formed between said lateral and medial segments of the heel support member, said gap being located such that a vertical line passing through said first end of the line of flexion passes through or adjacent to said gap; and said cushioning portion comprises differential cushioning means for reducing the compressive stiffness of the cushioning portion within the rearfoot strike zone relative to at least a medial side of the remaining heel area, said differential cushioning means including a resilient substantially gas-filled bladder chamber positioned within said rearfoot strike zone.

30. Athletic footwear according to claim 29, wherein said line of flexion is formed along a groove opening to a bottom surface of said sole and extending at least part way into a midsole portion of the sole.

31. Athletic footwear according to claim 30, wherein said groove varies in depth along its length.

32. Athletic footwear according to 29, wherein said line of flexion is formed along a least two separate grooves opening to a bottom surface of said sole and extending at least part way into a midsole portion of the sole.

33. Athletic footwear according to claim 29, wherein said line of flexion is formed along a line of relatively flexible material provided within a midsole portion of the sole.

34. Athletic footwear according to claim 29, wherein said cushioning portion further comprises a second resilient substantially gas-filled bladder chamber extending within said remaining heel area, the first and second bladder chambers being fluidically isolated from each other and said first chamber having a lower fluid pressure than said second chamber, whereby the compressive stiffness of said first chamber is decreased relative to said second chamber.

35. Athletic footwear according to claim 29, wherein said bladder chamber in said rearfoot strike zone comprises a first chamber of a segmented bladder having a second chamber extending within said remaining heel area, said first chamber and second chamber being articulated with respect to each other through a relatively flexible bladder portion, said line of flexion being formed along said relatively flexible bladder portion.

36. Athletic footwear according to claim 35, wherein said first chamber comprises a major part of a midsole portion within the rearfoot strike zone.

37. Athletic footwear according to claim 36, wherein said first chamber has a sidewall portion which is substantially wholly exposed between said first and second ends of the line of flexion to form a flexible sidewall of the midsole portion.

38. Athletic footwear according to claim 37, wherein said second chamber has a sidewall portion which is substantially wholly exposed to form a flexible sidewall of the midsole portion extending along said remaining heel area.

39. Athletic footwear according to claim 35, wherein said first chamber is encapsulated by midsole material forming a midsole sidewall along said rearfoot strike zone, said sidewall having a gap into which said first chamber can flex during rearfoot strike, whereby the compressive stiffness of said first chamber is decreased relative to said second chamber.

40. Athletic footwear according to claim 39, wherein said gap extends substantially the distance between said first and second ends of the line of flexion.

41. Athletic footwear according to claim 35, wherein said first and second chambers are in fluid communication with each other through a passageway extending through said relatively flexible bladder portion.

42. Athletic footwear according to claim 29, wherein said bladder chamber is encapsulated by midsole material forming a midsole sidewall along said rearfoot strike zone, said sidewall having a gap into which said bladder chamber can flex during rearfoot strike, whereby the compressive stiffness of said bladder chamber is decreased.

43. Athletic footwear according to claim 29, wherein said first chamber is encapsulated by midsole material forming a midsole sidewall along said rearfoot strike zone, said sidewall forming a channel along said rearfoot strike zone and serving to further reduce the compressive stiffness of the rearfoot strike zone relative to the remaining heel area.

44. Athletic footwear according to claim 29, wherein said line of flexion is formed along a flexible juncture between said resilient fluid bladder chamber and adjoining midsole material within said remaining heel area.

45. Athletic footwear according to claim 29, wherein said second end of the line of flexion is adjacent to said nominal location of the junction of the calcaneus and cuboid bones of the foot.

46. Athletic footwear according to claim 29, wherein said line of flexion extends linearly between said first and second ends thereof.

47. Athletic footwear according to claim 29, wherein said line of flexion is arcuate along at least a portion of its length.

* * * * *